US006791498B2

(12) United States Patent
Boyle et al.

(10) Patent No.: US 6,791,498 B2
(45) Date of Patent: Sep. 14, 2004

(54) WIRELESS TERMINAL

(75) Inventors: Kevin R. Boyle, Horsham (GB); Peter J. Massey, Horley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/055,386

(22) Filed: Jan. 23, 2002

(65) Prior Publication Data

US 2002/0180648 A1 Dec. 5, 2002

(30) Foreign Application Priority Data

Feb. 2, 2001 (GB) ..... 0102768

(51) Int. Cl.[7] ..... H01Q 1/24
(52) U.S. Cl. ..... 343/702; 343/844
(58) Field of Search ..... 343/702, 700 MS, 343/829, 844–846

(56) References Cited

U.S. PATENT DOCUMENTS 4,876,552 A * 10/1989 Zakman ..... 343/702
5,903,822 A 5/1999 Sekine et al. ..... 455/89
5,977,916 A 11/1999 Vannatta et al. ..... 343/702
6,002,367 A * 12/1999 Engblom et al. .... 343/700 MS
6,140,966 A * 10/2000 Pankinaho ..... 343/700 MS
6,204,817 B1 * 3/2001 Edvardsson ..... 343/702
6,414,637 B2 * 7/2002 Keilen ..... 343/700 MS
6,424,300 B1 * 7/2002 Sanford et al. ..... 343/702

FOREIGN PATENT DOCUMENTS

EP 1094542 A2 4/2001 ..... H01Q/9/04

OTHER PUBLICATIONS

PHGB 010056 Paten Application (Pending), Ser. No.: 09/912,470, Entitled: Wireless Terminal, Inventors Kevin R. Boyle et la.

* cited by examiner

*Primary Examiner*—Shih-Chao Chen
(74) *Attorney, Agent, or Firm*—Dicran Halajian

(57) ABSTRACT

A wireless terminal having antenna diversity comprises a transceiver coupled to a plurality of antenna feeds and a ground conductor (902), the antenna feeds being coupled directly to the ground conductor (902). In one embodiment the ground conductor is a conducting case (902). The coupling may be via parallel plate capacitors (504) formed by a respective plate (506) and a surface (908) of the case (902). The case (902) acts as an efficient, wideband radiator, eliminating the need for separate antennas. Slots (912) may be provided to increase the radiating bandwidth of the terminal and improve its diversity performance. Good diversity performance is obtained in a range of environments, whether the terminal is hand-held or free-standing.

7 Claims, 8 Drawing Sheets

WIRELESS TERMINAL

FIELD OF THE INVENTION

The present invention relates to a wireless terminal providing antenna diversity, for example a mobile phone handset.

BACKGROUND OF THE INVENTION

Wireless terminals, such as mobile phone handsets, typically incorporate either an external antenna, such as a normal mode helix or meander line antenna, or an internal antenna, such as a Planar Inverted-F Antenna (PIFA) or similar.

Such antennas are small (relative to a wavelength) and therefore, owing to the fundamental limits of small antennas, narrowband. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Hence, because of the limits referred to above, it is not feasible to achieve efficient wideband radiation from small antennas in present-day wireless terminals.

A further problem with known antenna arrangements for wireless terminals is that they are generally unbalanced, and therefore couple strongly to the terminal case. As a result a significant amount of radiation emanates from the terminal itself rather than the antenna. A wireless terminal in which an antenna feed is directly coupled to the terminal case, thereby taking advantage of this situation, is disclosed in our co-pending unpublished United Kingdom patent application 0108899.6 (Applicant's reference PHGB010056). When fed appropriately, the terminal case acts as an efficient, wideband radiator.

In many situations it is desirable for a wireless terminal to implement antenna diversity, whereby two or more antennas are used together to improve performance over that which can be achieved with a single antenna. In general, antenna diversity results in better reception, power savings and hence longer battery life. However, provision of two or more conventional antennas in a wireless terminal, such as a mobile phone handset, requires a significant extra volume which is undesirable given the present trend to smaller and smaller handsets.

SUMMARY OF THE INVENTION

An object of the present invention is to provide a compact wireless terminal having antenna diversity and efficient radiation properties over a wide bandwidth.

According to the present invention there is provided a wireless terminal comprising a ground conductor and a transceiver coupled to a plurality of antenna feeds, wherein each antenna feed is coupled directly to the ground conductor.

Because the ground conductor (typically a handset body) is used as the radiating element, there is minimal extra volume required to implement antenna diversity (simply the volume occupied by a second capacitor or other coupling element). Hence, the present invention provides antenna diversity with a much-reduced volume requirement compared to known arrangements, while also providing a significantly larger bandwidth. Although the use of two feeds to a common radiating element might be expected to result in high correlation between the two antenna patterns, it is shown that in fact low correlation (and hence good diversity performance) is achieved in practice.

The present invention is based upon the recognition, not present in the prior art, that the impedances of an antenna and a wireless handset are similar to those of an asymmetric dipole, which are separable, and on the further recognition that the antenna impedance can be replaced with a non-radiating coupling element.

BRIEF DESCRIPTION OF THE DRAWINGS

Embodiments of the present invention will now be described, by way of example, with reference to the accompanying drawings, wherein.

DETAILED DESCRIPTION OF THE PREFERRED EMBODIMENTS

Figure 1:
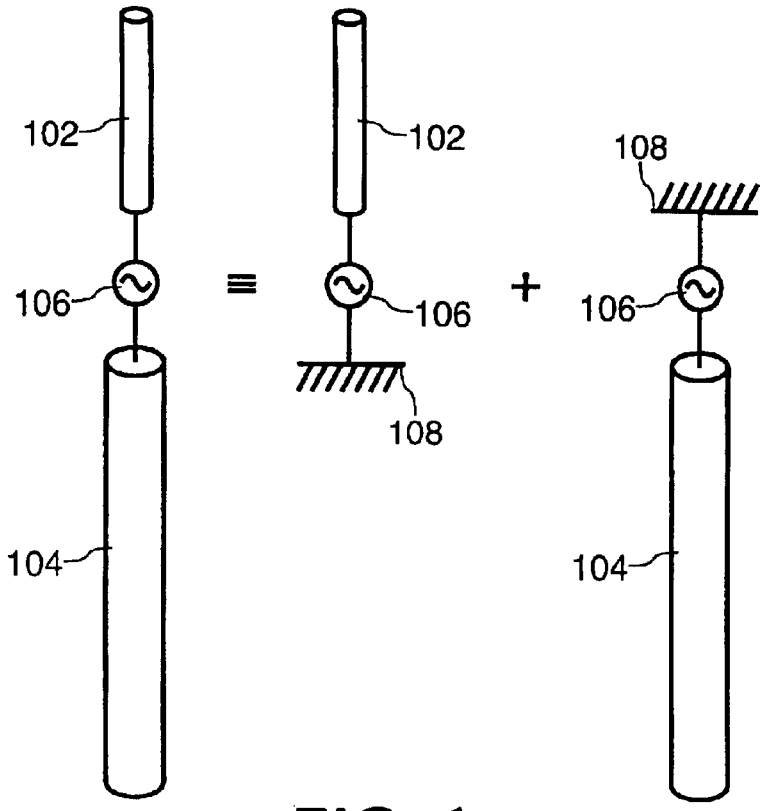
FIG. 1 shows a model of an asymmetrical dipole antenna, representing the combination of an antenna and a wireless terminal.

In the drawings the same reference numerals have been used to indicate corresponding features.

FIG. 1 shows a model of the impedance seen by a transceiver, in transmit mode, in a wireless handset at its antenna feed point. The impedance is modelled as an asymmetrical dipole, where the first arm 102 represents the impedance of the antenna and the second arm 104 the impedance of the handset, both arms being driven by a source 106. As shown in the figure, the impedance of such an arrangement is substantially equivalent to the sum of the impedance of each arm 102, 104 driven separately against a virtual ground 108. The model could equally well be used for reception by replacing the source 106 by an impedance representing that of the transceiver, although this is rather more difficult to simulate.

Figure 2:
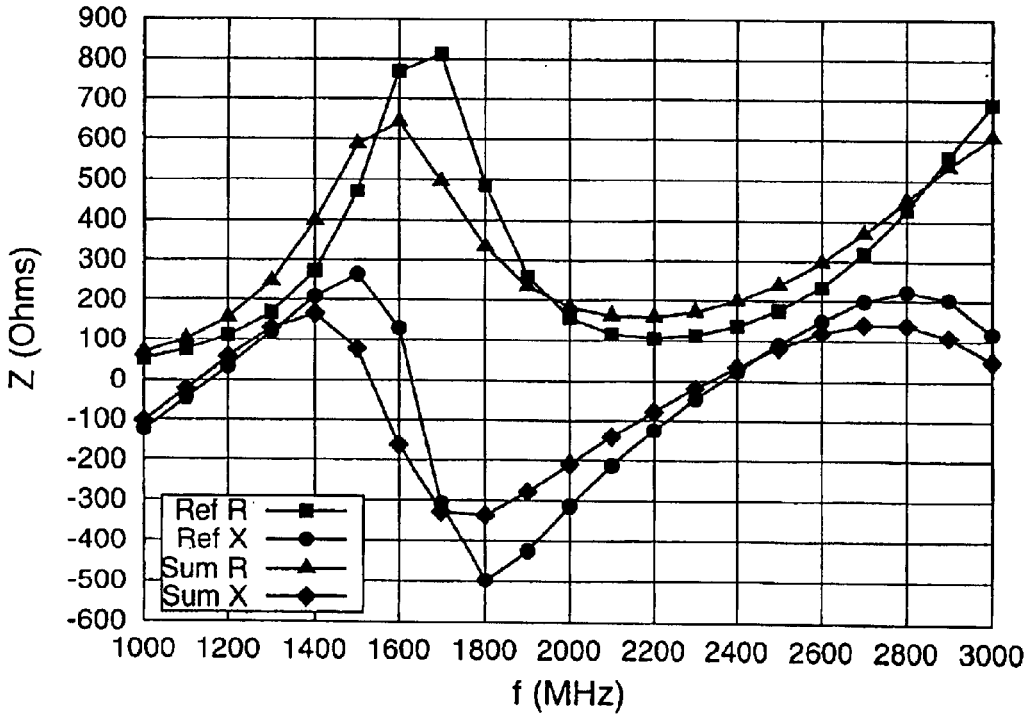
FIG. 2 is a graph demonstrating the separability of the components of the impedance of an asymmetrical dipole.

The validity of this model was checked by simulations using the well-known NEC (Numerical Electromagnetics Code) with the first arm 102 having a length of 40 mm and a diameter of 1 mm and the second arm 104 having a length of 80 mm and a diameter of 1 mm. FIG. 2 shows the results for the real and imaginary parts of the impedance (R+jX) of the combined arrangement (Ref R and Ref X) together with results obtained by simulating the impedances separately and summing the result. It can be seen that the results of the simulations are quite close. The only significant deviation is in the region of half-wave resonance, when the impedance is difficult to simulate accurately.

Figure 3:
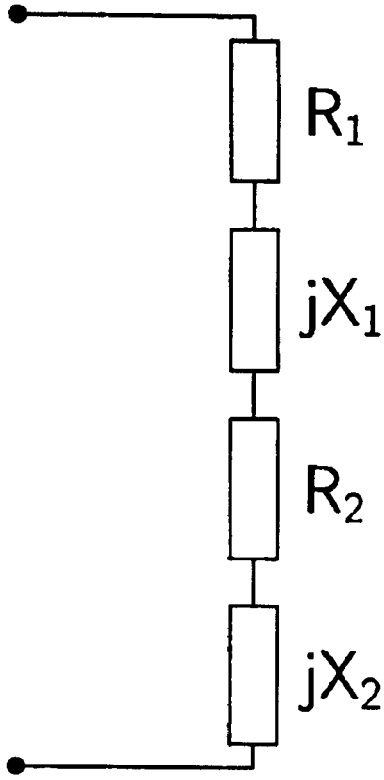
FIG. 3 is an equivalent circuit of the combination of a handset and an antenna.

An equivalent circuit for the combination of an antenna and a handset, as seen from the antenna feed point, is shown in FIG. 3. $R_1$ and $jX_1$ represent the impedance of the antenna, while $R_2$ and $jX_2$ represent the impedance of the handset. From this equivalent circuit it can be deduced that the ratio of power radiated by the antenna, $P_1$, and the handset, $P_2$, is given by $$\frac{P_1}{P_2} = \frac{R_1}{R_2}$$

If the size of the antenna is reduced, its radiation resistance $R_1$ will also reduce. If the antenna becomes infinitesimally small its radiation resistance $R_1$ will fall to zero and all of the radiation will come from the handset. This situation can be made beneficial if the handset impedance is suitable for the source 106 driving it and if the capacitive reactance of the infinitesimal antenna can be minimised by increasing the capacitive back-coupling to the handset.

Figure 4:
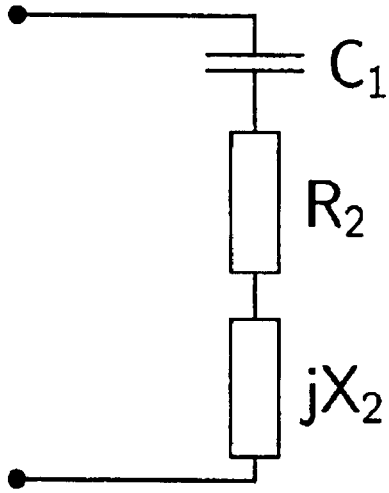
FIG. 4 is an equivalent circuit of a capacitively back-coupled handset.

With these modifications, the equivalent circuit is modified to that shown in FIG. 4. The antenna has therefore been replaced with a physically very small back-coupling capacitor, designed to have a large capacitance for maximum coupling and minimum reactance. The residual reactance of the back-coupling capacitor can be tuned out with a simple matching circuit. By correct design of the handset, the resulting bandwidth can be much greater than with a conventional antenna and handset combination, because the handset acts as a low Q radiating element (simulations show that a typical Q is around 1), whereas conventional antennas typically have a Q of around 50.

Figure 5:
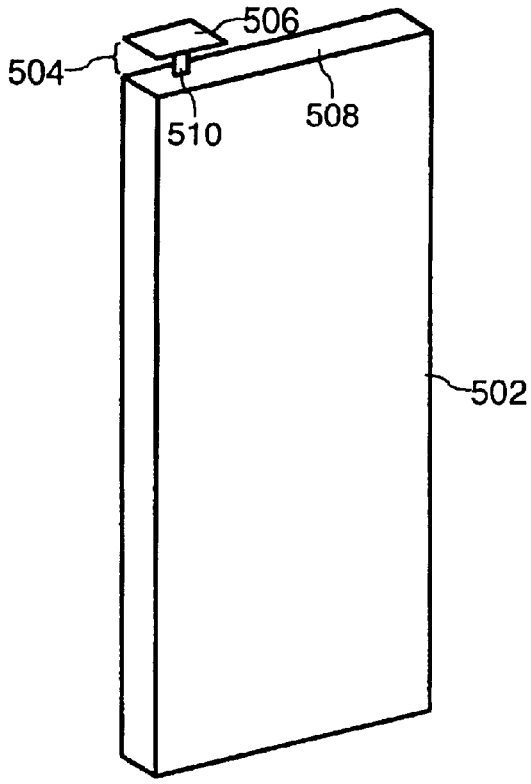
FIG. 5 is a perspective view of a basic capacitively back-coupled handset.

A basic embodiment of a capacitively back-coupled handset is shown in FIG. 5. A handset 502 has dimensions of 10×40×100 mm, typical of modern cellular handsets. A parallel plate capacitor 504, having dimensions 2×10×10 mm, is formed by mounting a 10×10 mm plate 506 2 mm above the top edge 508 of the handset 502, in the position normally occupied by a much larger antenna. The resultant capacitance is about 0.5 pF, representing a compromise between capacitance (which would be increased by reducing the separation of the handset 502 and plate 506) and coupling effectiveness (which depends on the separation of the handset 502 and plate 506). The capacitor is fed via a support 510, which is insulated from the handset case 502.

Figure 6:
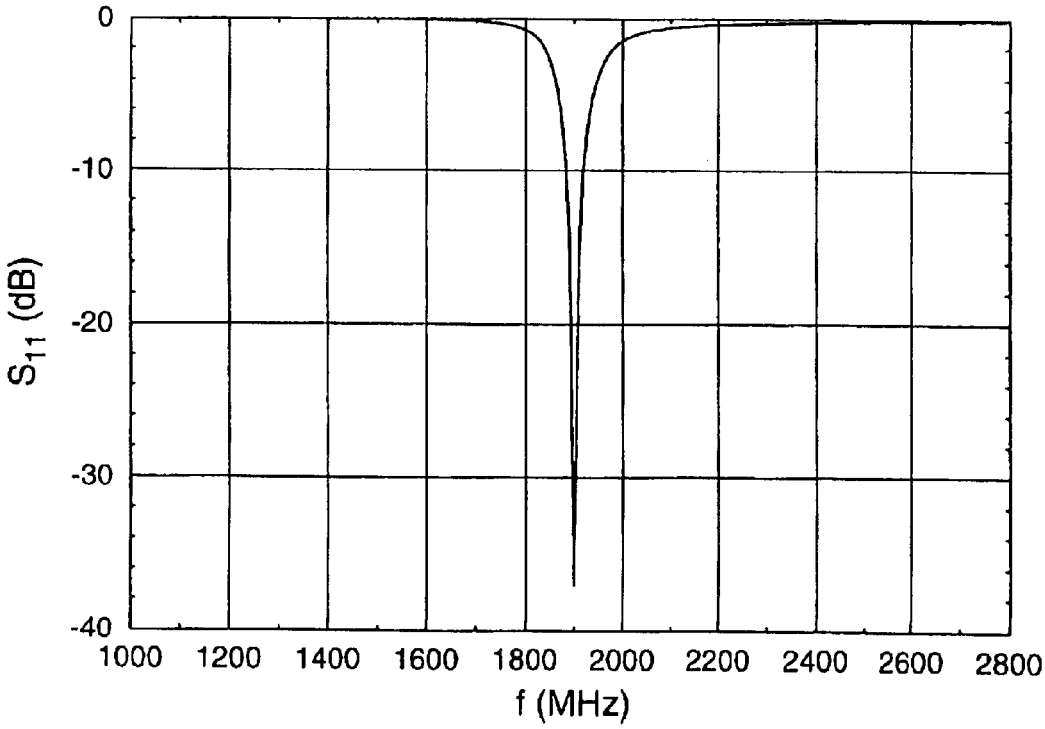
FIG. 6 is a graph of simulated return loss $S_{11}$ in dB against frequency f in MHz for the handset of FIG. 5.
Figure 7:
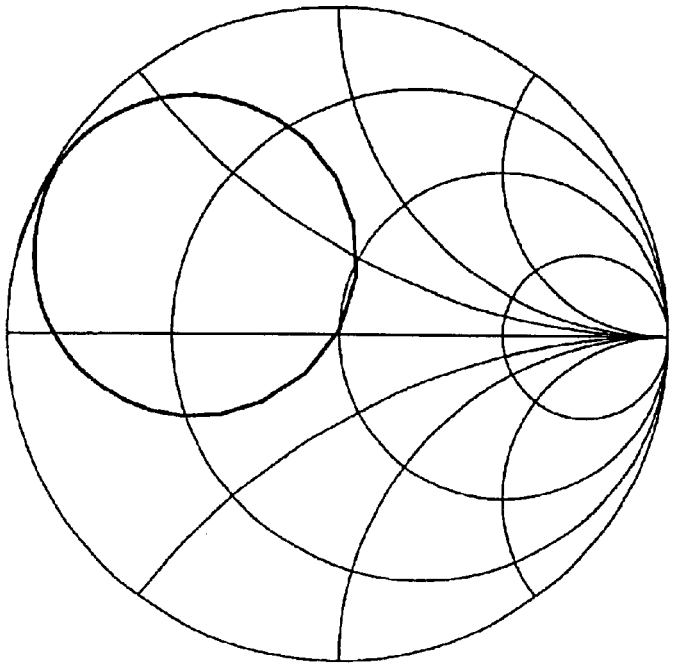
FIG. 7 is a Smith chart showing the simulated impedance of the handset of FIG. 5 over the frequency range 1000 to 2800 MHz.

The return loss $S_{11}$ of this embodiment after matching was simulated using the High Frequency Structure Simulator (HFSS), available from Ansoft Corporation, with the results shown in FIG. 6 for frequencies f between 1000 and 2800 MHz. A conventional two inductor "L" network was used to match at 1900 MHz. The resultant bandwidth at 7 dB return loss (corresponding to approximately 90% of input power radiated) is approximately 60 MHz, or 3%, which is useful but not as large as was required. A Smith chart illustrating the simulated impedance of this embodiment over the same frequency range is shown in FIG. 7.

Figure 8:
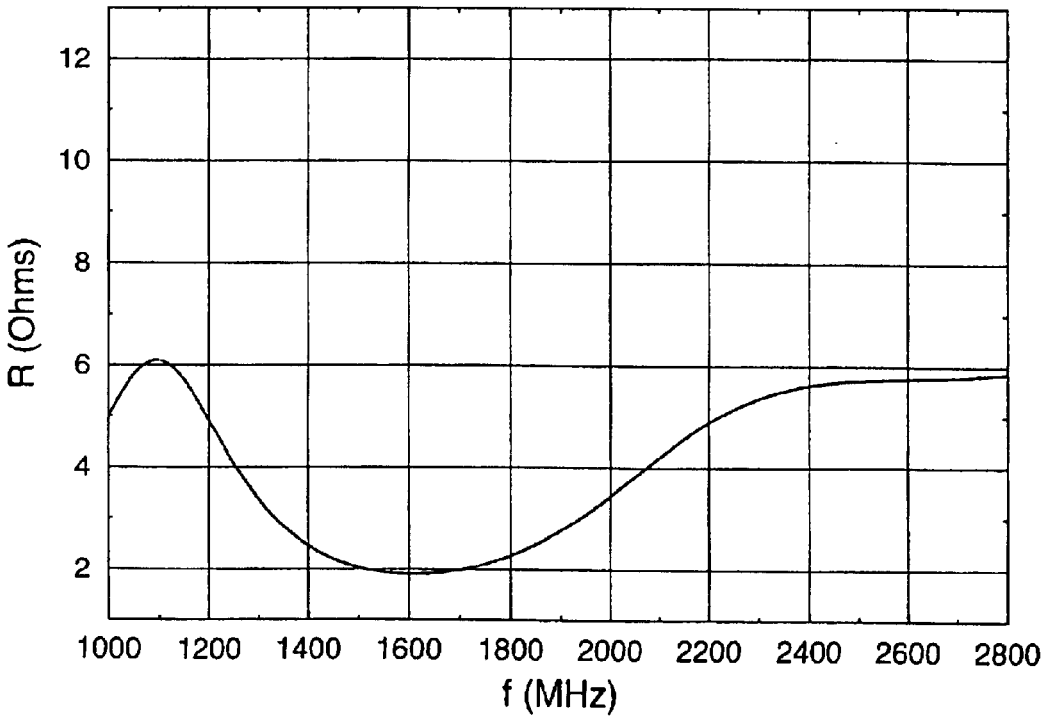
FIG. 8 is a graph showing the simulated resistance of the handset of FIG. 5.

The low bandwidth is because the combination of the handset 502 and capacitor 504 present an impedance of approximately 3-j90Ω at 1900 MHz. FIG. 8 shows the resistance variation, over the same frequency range as before, simulated using HFSS. This can be improved by redesigning the case to increase the resistance, for example by the use of a slot or a narrower handset, as discussed in our co-pending unpublished United Kingdom patent application 0019335.9

Figure 9:
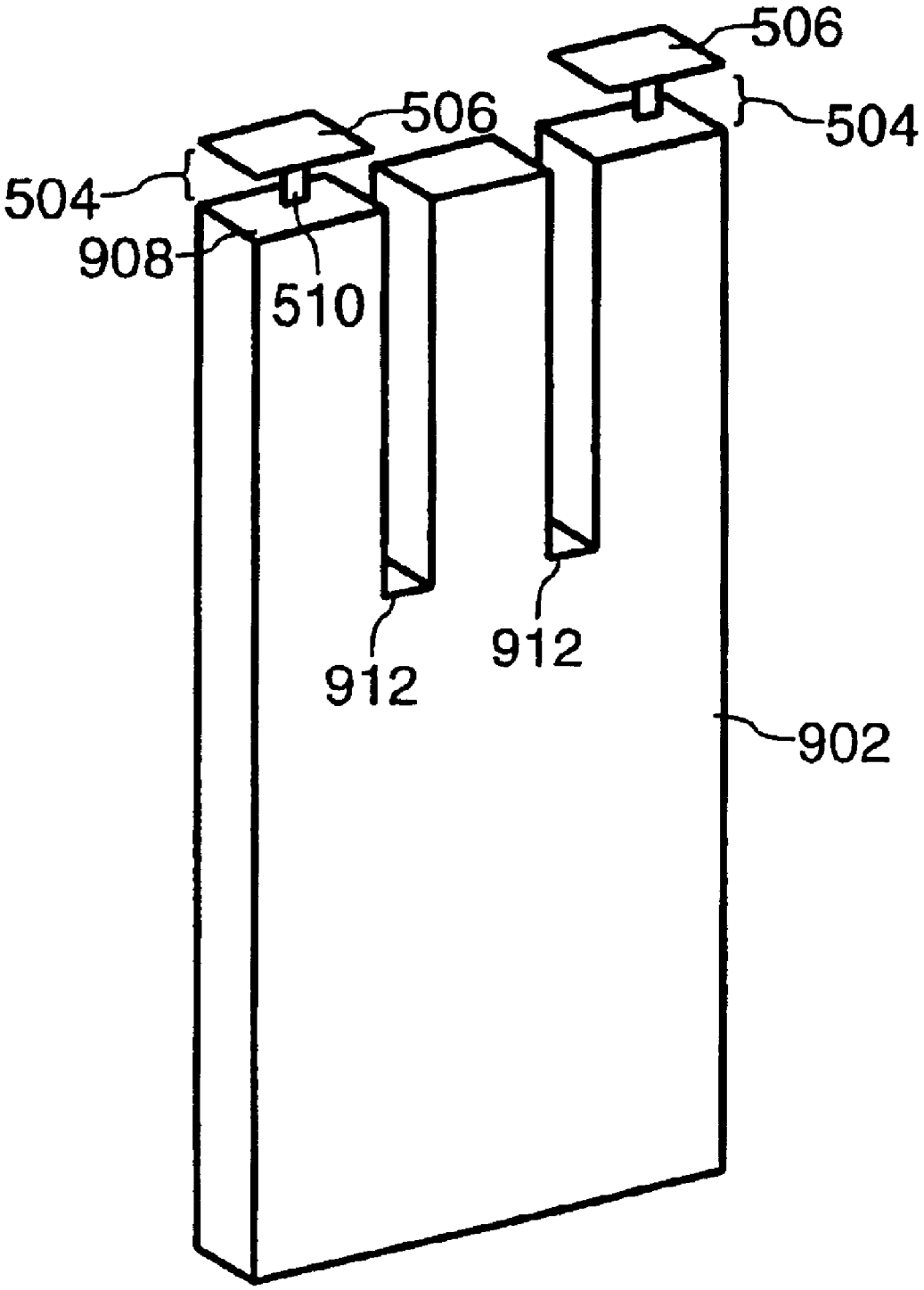
FIG. 9 is a perspective view of a doubly-slotted capacitively back-coupled handset having two feeds.

In order to provide antenna diversity, at least two coupling elements are required. An example of how this can be done is shown in FIG. 9. A diversity handset 902 has a conducting case having dimensions of 10×40×100 mm, into which two slots 912 have been cut. Each slot 912 has a width of 3 mm and a depth of 29.5 mm and is placed 12 mm in from a side of the handset 902. As in the previous embodiment, a capacitor 504 is formed from a plate 506, having dimensions 10×10 mm, mounted 4 mm above the top surface 908 of the handset 902 on a support 510.

Figure 10:
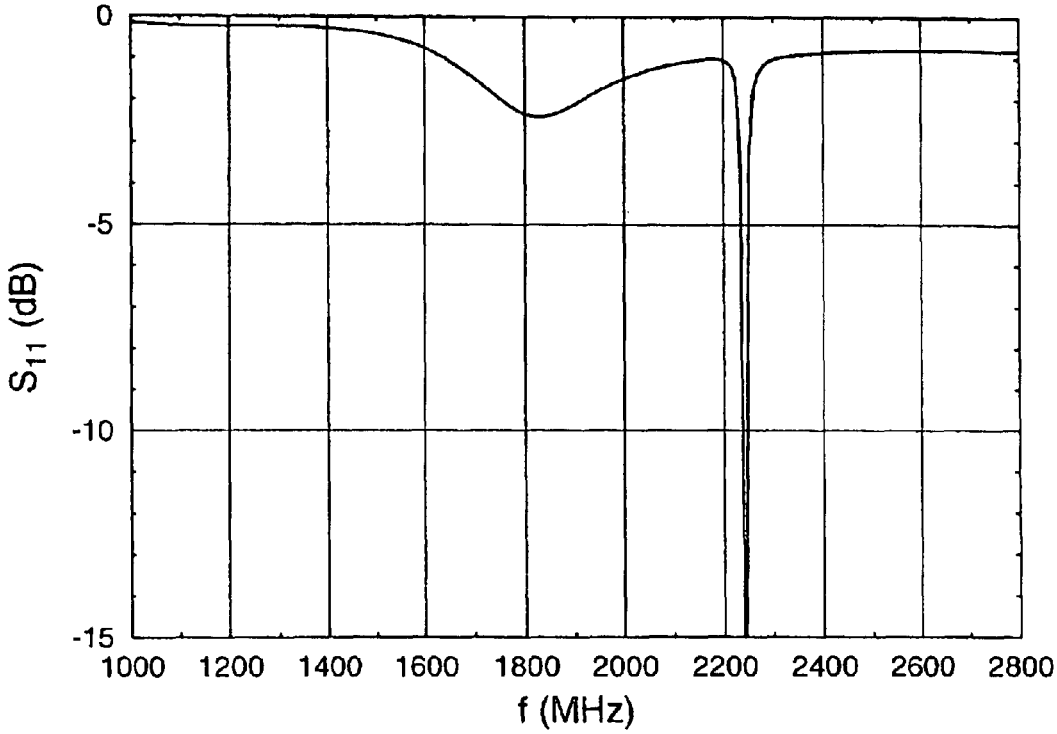
FIG. 10 is a graph of simulated return loss $S_{11}$ in dB against frequency f in MHz for one feed of the handset of FIG. 9.
Figure 11:
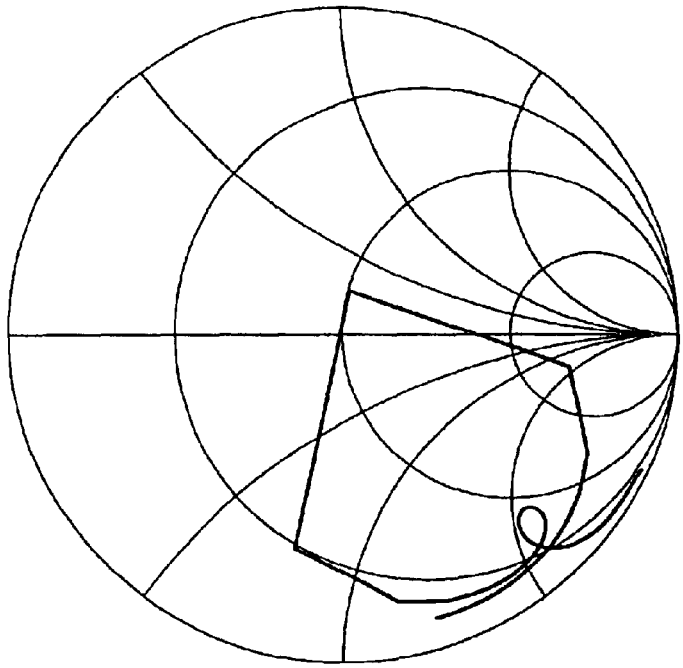
FIG. 11 is a Smith chart showing the simulated impedance of one feed of the handset of FIG. 9 over the frequency range 1000 to 2800 MHz.

The return loss $S_{11}$ of this embodiment was simulated using HFSS, with the results shown in FIG. 10 for frequencies f between 1000 and 2800 MHz. In the simulation one capacitor 504 was fed directly, without matching, while the other capacitor 504 was left open circuit. There are two resonances present, one centred at 1.83 GHz and the other at 2.24 GHz. The first resonance is similar to that which would be achieved if only one capacitor 504 and slot 912 were present, as shown in our co-pending unpublished UK patent application 0019335.9. The second resonance is due to the presence of an additional slot 912. The centre frequency of the first resonance is reduced by the presence of a second slot 912, and hence the length of the slots 912 is reduced compared to an embodiment having a single slot. A Smith chart illustrating the simulated impedance of this embodiment over the same frequency range is shown in FIG. 11. The rapid changes in impedance in the Smith chart reflect the narrow-band nature of the second resonance.

The response of this embodiment can be improved by matching. Simulations were performed using a similar two inductor matching network to that employed in the basic embodiment, but matching both feeds simultaneously. This would be used in a dual receiver diversity architecture, where both antennas are available simultaneously. Similar performance could be obtained with one feed connected and matched while the other is disconnected or loaded with another impedance, as would be used in a switched diversity configuration.

Figure 12:
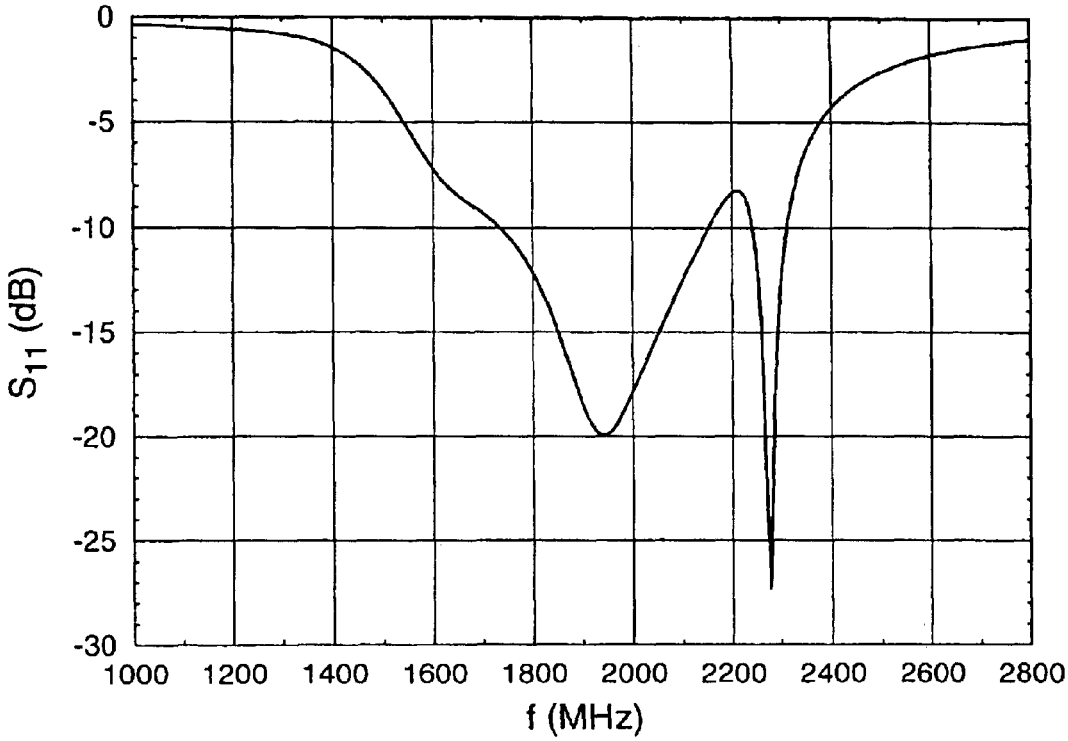
FIG. 12 is a graph of simulated return loss $S_{11}$ in dB against frequency f in MHz for one feed of the handset of FIG. 9 with additional matching.
Figure 13:
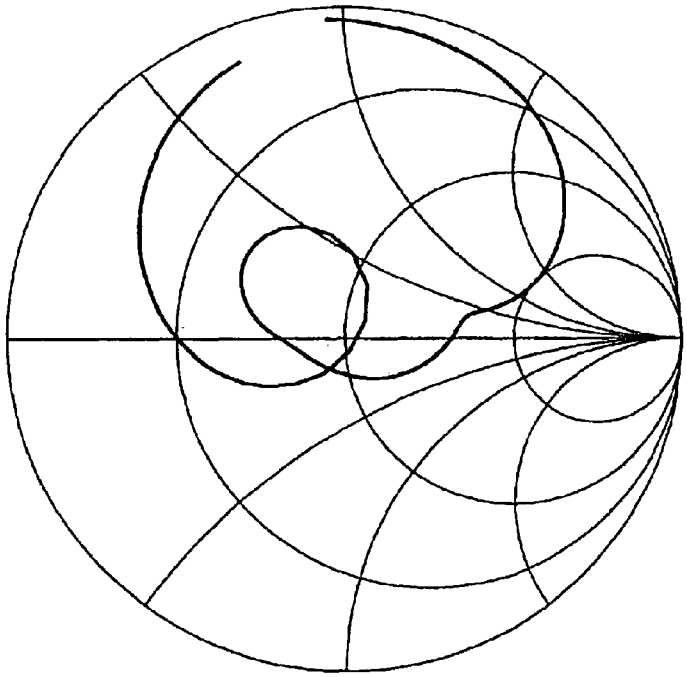
FIG. 13 is a Smith chart showing the simulated impedance of one feed of the handset of FIG. 9, with additional matching, over the frequency range 1000 to 2800 MHz.

Results for the return loss $S_{11}$ are shown in FIG. 12 for frequencies f between 1000 and 2800 MHz. The resultant bandwidth at 7 dB return loss is now approximately 750 MHz, or nearly 40%. This is more than enough to cover UMTS and DCS 1800 bands simultaneously, which require coverage from 1710 to 2170 MHz. A Smith chart illustrating the simulated impedance of this embodiment over the same frequency range is shown in FIG. 13.

Figure 14:
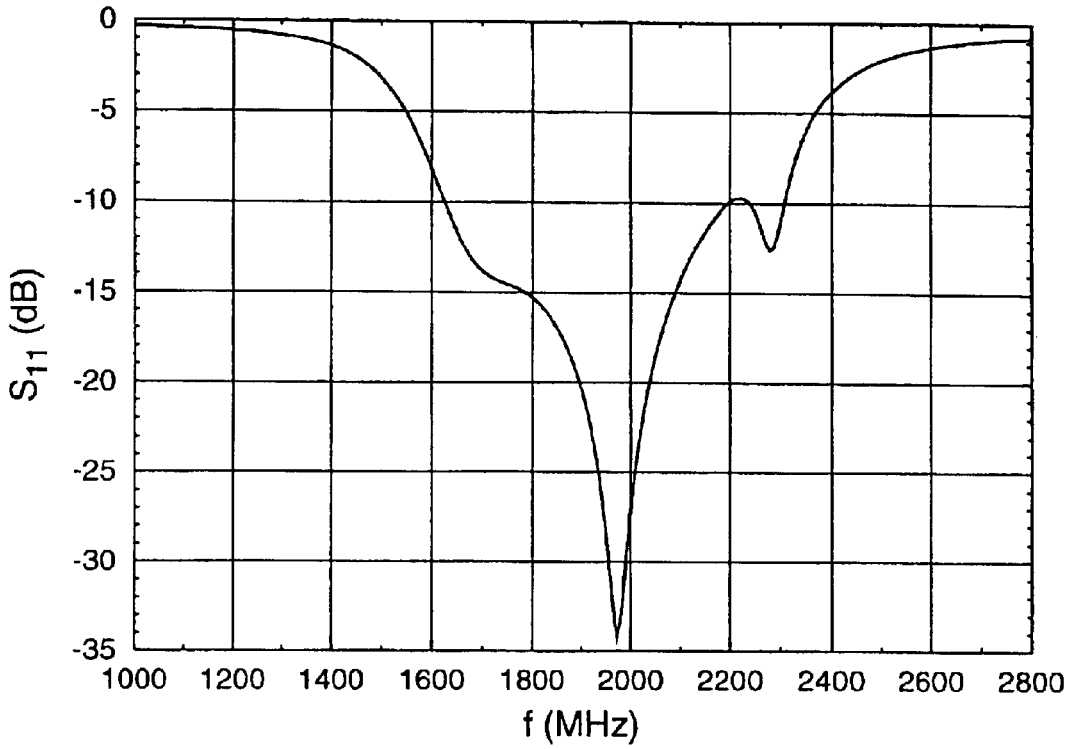
FIG. 14 is a graph of simulated return loss S11 in dB against frequency f in MHz for one feed of the handset of FIG. 9 with additional matching and held in a hand.
Figure 15:
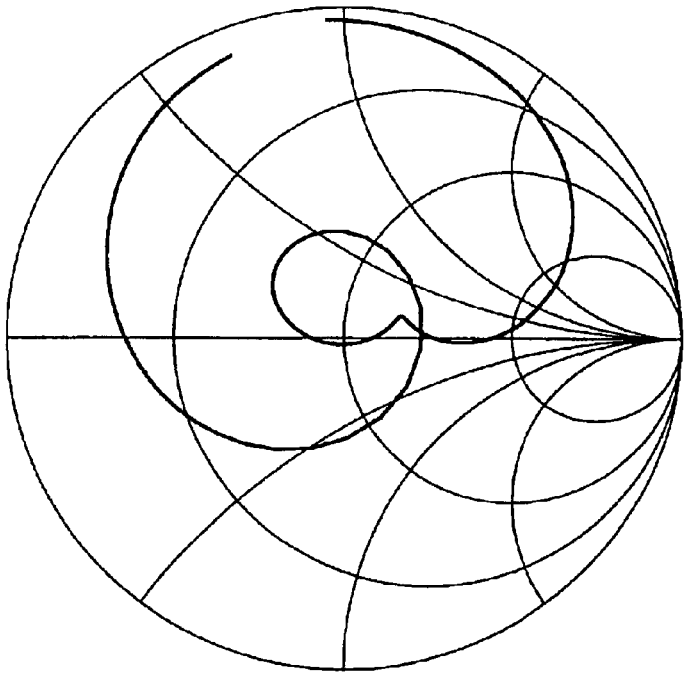
FIG. 15 is a Smith chart showing the simulated impedance of one feed of the handset of FIG. 9, with additional matching and held in a hand, over the frequency range 1000 to 2800 MHz.

Further simulations were performed in which the handset was hand-held, with a 1 cm-thick hand placed around the lowest 60 mm of the handset and surrounding it on three sides. The hand was simulated as a uniform volume of complex dielectric material, having a dielectric constant of 49 and a conductivity of 1.6 S/m at 1900 MHz. Results for return loss $S_{11}$ and a Smith chart are shown in FIGS. 14 and 15 respectively. Despite the handset acting as part of the radiating system, the antenna efficiency is only reduced by 27% (computed as the ratio of input power to power integrated over the problem space boundary in the simulation.) This is a similar reduction in efficiency to that found when conventional handsets are hand-held.

For antenna diversity to be useful, it is necessary that the radiation patterns of the individual antennas are sufficiently decorrelated. A correlation of less than 0.7 is generally taken to indicate good diversity performance. The correlation of the handset 902 was computed, for matched feeds, at three frequencies across the operating band and for a variety of usage scenarios, with the following results:

| | Frequency (MHz) | | |
|---|---|---|---|
| Environment | 1711 | 1918 | 2170 |
| rural | 0.58 | 0.21 | 0.63 |
| suburban | 0.46 | 0.10 | 0.51 |
| urban macro/microcell | 0.45 | 0.10 | 0.50 |
| urban picocell | 0.46 | 0.11 | 0.51 |
| outdoors to indoors | 0.34 | 0.04 | 0.37 |
| indoors | 0.35 | 0.05 | 0.39 |

The correlation was also computed for a hand-held handset, with the hand covering the lower 60 mm of three sides of the handset 902. The following results were obtained:

| | Frequency (MHz) | | |
|---|---|---|---|
| Environment | 1711 | 1918 | 2170 |
| rural | 0.21 | 0.04 | 0.45 |
| suburban | 0.14 | 0.05 | 0.46 |
| urban macro/microcell | 0.18 | 0.06 | 0.45 |
| urban picocell | 0.10 | 0.00 | 0.38 |
| outdoors to indoors | 0.06 | 0.02 | 0.30 |
| indoors | 0.09 | 0.01 | 0.31 |

The above results clearly demonstrate that good diversity performance is obtained in a range of environments over a wide bandwidth. Results would be expected to be similarly good for the case of one capacitor 504 fed with the other capacitor 504 terminated in an unmatched load, as would be the case for switched diversity.

The diversity embodiment described above made use of slots 912 in the handset case 902 to enhance the feed match for coverage of both DCS1800 and UMTS bands. Other embodiments are possible (including those without handset slots) which may trade off bandwidth against volume for example. When slots are provided, they may be extended to run the full length of the handset, and additional slots may also be provided for enhanced multi-band operation. The function of the slots 912 in the diversity embodiment described above is to provide an impedance transformation so that the antenna feed provides a reasonable match to 50Ω. Adequate diversity performance should be achieved providing that the antenna feeds are separated sufficiently on the ground conductor 902 (for example those in FIG. 9 are separated by approximately 0.2 wavelengths at 1711 MHz).

The embodiments disclosed above are based on capacitive coupling. However, any other sacrificial (non-radiating) coupling element could be used instead, for example inductive coupling. Also, the coupling element could be altered in order to aid impedance matching. For example, capacitive coupling could be achieved via an inductive element. This would allow easier matching to yield a more wideband response.

In the above embodiments a conducting handset case has been the radiating element. However, other ground conductors in a wireless terminal could perform a similar function. Examples include conductors used for EMC shielding and an area of Printed Circuit Board (PCB) metallisation, for example a ground plane.

From reading the present disclosure, other modifications will be apparent to persons skilled in the art. Such modifications may involve other features which are already known in the design, manufacture and use of wireless terminals and component parts thereof, and which may be used instead of or in addition to features already described herein.

In the present specification and claims the word "a" or "an" preceding an element does not exclude the presence of a plurality of such elements. Further, the word "comprising" does not exclude the presence of other elements or steps than those listed.

What is claimed is:

1. A wireless terminal comprising a ground conductor and a plurality of antenna feeds, wherein each antenna feed is coupled directly to the ground conductor, wherein each side of the ground conductor has a surface area greater than the surface area of each of the plurality of antenna feeds, wherein the ground conductor has at least one uni-directional slot extending parallel to the longitudinal axis of the terminal, and wherein the slot provides a gap between the plurality of antenna feeds.

2. The terminal as claimed in claim 1, characterised in that each antenna feed is coupled to the ground conductor via a capacitor.

3. The terminal as claimed in claim 2, characterised in that the capacitor is a parallel plate capacitor formed by a conducting plate and a portion of the ground conductor.

4. The terminal as claimed in claim 1, characterised in that the at least one uni-directional slot extending parallel to the longitudinal axis provides a tuning fork configuration having at least three tines at at least one end of the ground conductor.

5. The terminal as claimed in claim 1, characterised in that a first of the at least one uni-directional slot extending parallel to the longitudinal axis is parallel to a second of the at least one uni-directional slot.

6. The terminal as claimed in claim 1, characterised in that the ground conductor is a handset case.

7. The terminal as claimed in claim 1, characterised in that a matching network is provided for each antenna feed.

* * * * *